United States Patent [19]

Sams

[11] 4,243,190

[45] Jan. 6, 1981

[54] ROTARY WING DEVICE

[76] Inventor: Kenneth Sams, 88 Boileau Rd., London W5, England

[21] Appl. No.: 18,451

[22] Filed: Mar. 8, 1979

[30] Foreign Application Priority Data

Aug. 30, 1978 [GB] United Kingdom ..... 34963/78

[51] Int. Cl.[3] ..... B64C 31/06

[52] U.S. Cl. ..... 244/153 A; 244/9; 244/39

[58] Field of Search ..... 244/153 R, 153 A, 154, 244/39, 155 A, 9, 19, 218; D21/85, 86, 88, 89; 46/75, 77

[56] References Cited

U.S. PATENT DOCUMENTS

| | | | |
|---|---|---|---|
| D. 166,440 | 4/1952 | Benson | D21/88 |
| 1,133,984 | 3/1915 | McCarley | 244/9 |
| 1,927,835 | 9/1933 | Kellogg | 244/154 |
| 2,038,337 | 4/1936 | Ballmann | 244/218 |
| 2,768,803 | 10/1956 | Smith | 244/153 A |
| 3,076,626 | 2/1963 | Andrews | 244/154 |
| 3,098,634 | 7/1963 | Finklea | 244/153 R |
| 3,506,220 | 4/1970 | Shrilli | 244/19 |
| 3,791,611 | 2/1974 | Babbidge | 244/153 R |
| 4,012,017 | 3/1977 | Springston et al. | 244/153 A |
| 4,121,794 | 10/1978 | Lemelson | 244/153 A |

FOREIGN PATENT DOCUMENTS

| | | | |
|---|---|---|---|
| 197804 | 4/1978 | United Kingdom | 244/39 |

*Primary Examiner*—Barry L. Kelmachter
*Attorney, Agent, or Firm*—Harry B. Keck

[57] ABSTRACT

A rotary wing device has a circular stabilizer disc and, secured normally thereto, a bilaterally symmetrical wing member having a first symmetry axis intersecting the center of the stabilizer disc. The ends of the wing member at the first symmetry axis are connected through pin connections to a string harness whereby the device functions as a kite when the wing member rotates about the first symmetry axis. At least one guy wire connects the frame of the stabilizer disc to the frame of the wing member in each quadrant of the device. The same device may function in free flight without the string harness. The device preferably is fabricated from rod or tube frames covered with plastic films.

12 Claims, 7 Drawing Figures

ROTARY WING DEVICE

BACKGROUND OF THE INVENTION

1. Field of the Invention

This invention relates to rotary wing devices which are suitable for use as kites but which may have other applications.

2. Description of the Prior Art

Rotary wing kites of the prior art have been difficult to control in flight. See DESIGN Pat. No. 160,910; U.S. Pat. No. 4,121,794.

SUMMARY OF THE INVENTION

Rotary wing devices, as kites, rotate about a first symmetry axis of the wing member in an air current and obtain a lift in accordance with the Magnus effect.

The present rotary wing device provides increased performance and economy of construction. The present rotary wing device comprises a flat wing member and a flat stabilizer disc which are joined together at right angles. The flat wing member possesses bilateral symmetry and its first symmetry axis intersects the center of the stabilizer disc whereby the entire rotary wing device is radially symmetrical about the first symmetry axis. Both the wing member and the stabilizer disc are formed from an outline framework which is covered by a dimensionally stable film. The wing member and the stabilizer disc are connected together by providing a central slot in the stabilizer disc through which the wing member is inserted.

Rigidity of the rotary wing device is achieved by means of guy wires which extend from the edges of the stabilizer disc to the edges of the wing member in each quadrant of the device. The guy wires function to transfer stresses from the wing member to the stabilizer disc and vice versa. Fastening pins are provided at the intersection of the outer edges of the wing member with the first symmetry axis. A suitable kite harness, which may be flaccid or rigid, is connected as a "V" to the fastening pins (at the free end of the "V"), and to a kite-string at the apex of the "V".

In an alternative embodiment, the harness and kite-string may be omitted and the device may be used as a free flight device. In a further alternative embodiment, two or more of the rotary wing devices may be assembled on a common frame; driving means are provided on the frame to rotate the wing members relative to the frame.

Figures 1, 2, 3:
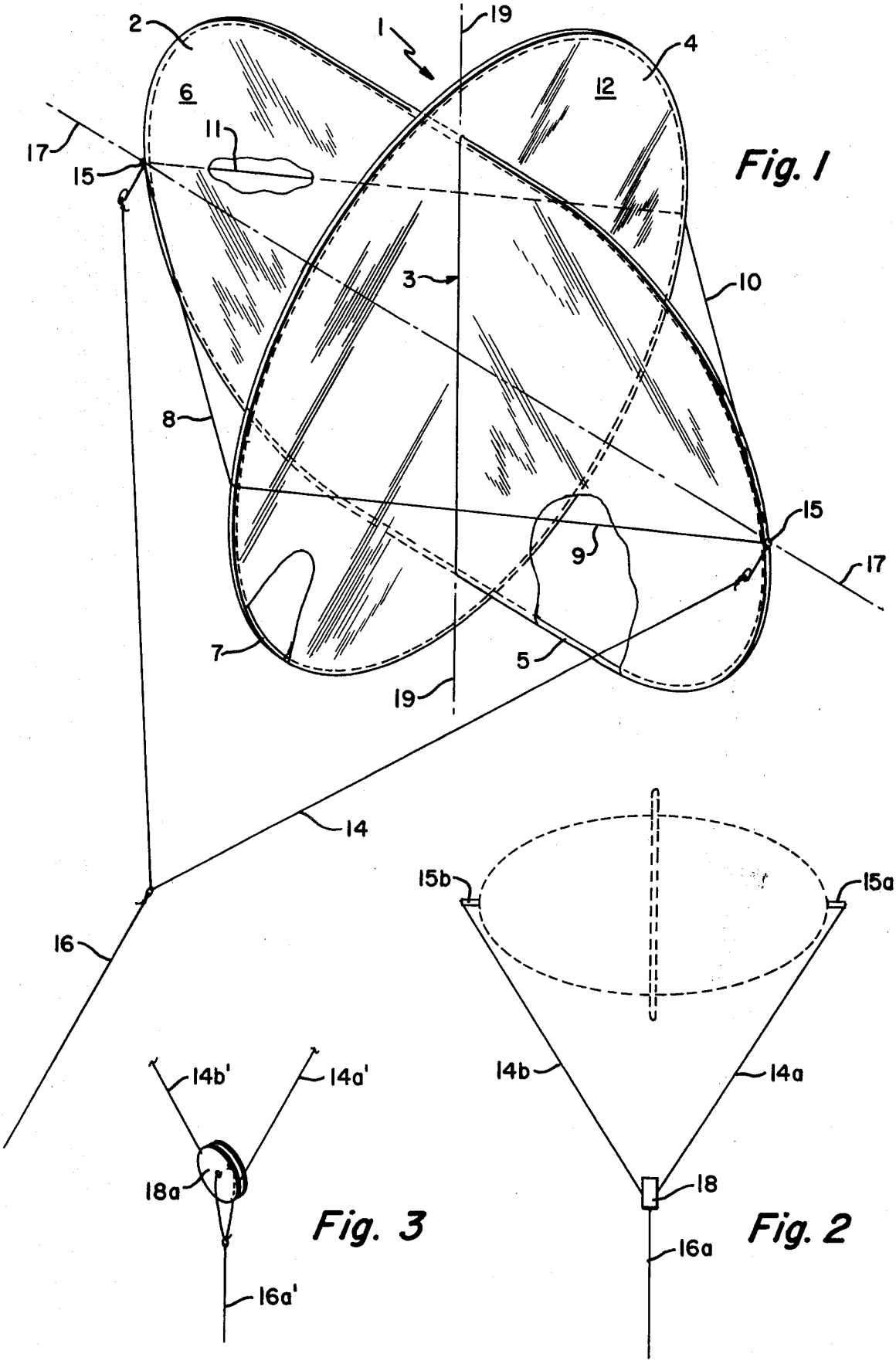
FIG. 1 is a perspective view of one form of the rotary wing device.
FIG. 2 is a schematic view of an alternative kite-string and harness connection.
FIG. 3 is a sketch of a harness and kite-string connection.
Figure 7:
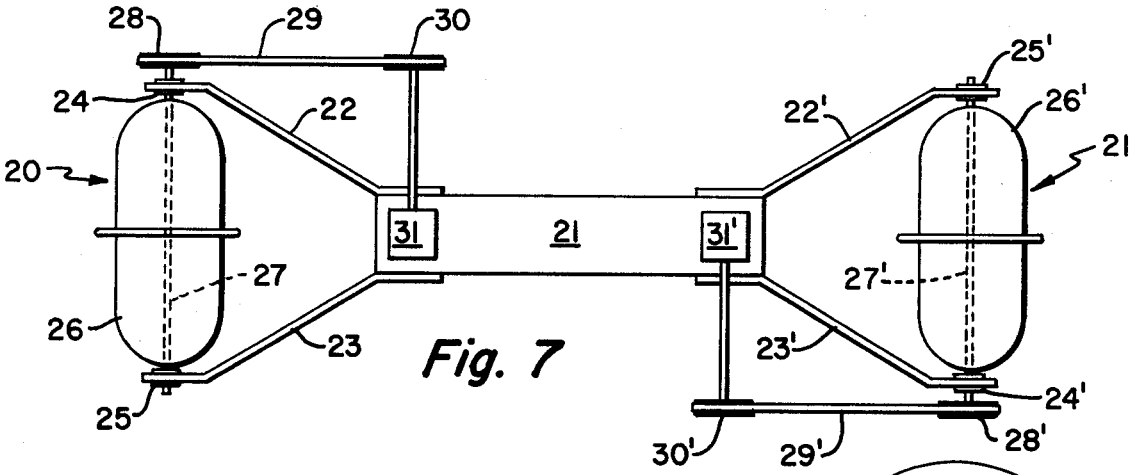
FIG. 7 is a plan view of a device having two rotary wing devices connected to a common frame.

The rotary wing device 1 comprises a flat wing member 2, shown as elliptical in shape, which fits into a slot 3 centrally positioned in a stabilizer disc 4. The wing member 2 has a peripheral frame 5. The stabilizer disc 4 has a circular frame 7. The frames 5, 7 may be made of shaped wood, metal or plastic. Metal or plastic rod or tubing is preferred. A particularly useful frame material is plastic rod or tubing such as glass-fiber-reinforced plastic or carbon-filament-reinforced plastic rod or tubing. A covering membrane 6 is provided for the wing member 2. A covering membrane 12 is provided for the stabilizer disc 4. The covering membrane 6, 12 stretch across the frames 5, 7 respectively and are fastened thereto by means of adhesives or tapes or by film-shrinking procedures. Typically the stabilizer disc 2 has a diameter from six inches to three feet when the device is employed as a kite.

The covering material preferably is a thin plastic film, such as polyethylene terephthalate which is sold in the U.S.A. under the trademark Mylar and is sold elsewhere under the trademark Melonex. Such material in 0.5 mil thickness is optimum for kite construction. The covering material may be used in thicker or thinner films. The polyethylene terephthalate films are dimensionally stable, have a useful film strength, are resistant to puncture and tearing. Other useful covering materials include other plastic films such as polyethylene, polypropylene, polyvinyl chloride, polyvinyl fluoride, polyvinylidene chloride, metal foils, woven fabrics, non-woven fabrics, strong papers and the like.

The stabilizer disc 4 has a central slot 3 formed across a diameter for receiving the wing member 2. With the wing member 2 centered in the slot 3, the coverings 6, 12 may be sealed, together along the slot 3 suitably by means of an adhesive tape or appropriate sealant.

For packaging and transporting purposes, the stabilizer disc 4 can be rotated about its diameter relative to the wing member 2 so as to lie flat against the wing member 2. When the device is assembled, guy wires 8, 9, 10, 11 extend from the edges of the stabilizer disc 4 to the edges of the flat wing member 2 in each quadrant of the device. The guy wires 8, 9, 10, 11 provide stability and rigidity for the assembled device and serve to transfer stresses from the stabilizer disc to the wing member and vice versa. The guy wires may be fabricated from plastic filaments or woven plastic strands, from metal wires, from suitable threads or strings.

The rotary wing device can be readily assembled and disassembled by providing two opposed guy wires, e.g., 9, 11, which are detachably engaged, as by a hook and eye connection. By detaching opposing guy wires, the stabilizer disc 4 can be rotated in the direction of the remaining guy wires until it lies flat against the wing member 2. To reassemble the device, the stabilizer disc 4 is repositioned and the two detached guy wires are reconnected.

While FIG. 1 shows a single guy wire in each quadrant of the device, it should be understood that multiple guy wires may be provided in each quadrant connecting the stabilizer disc frame 7 to the rotary wing member frame 5.

The wing member 2 is essentially flat. This feature is believed to be the reason for the outstanding flying ability of the present rotary wing device—in comparison with prior similar devices which have employed profiled wing members.

A harness 14 is attached by pin connections 15 to the ends of the wing member 2. The pin members 15 are aligned with the first symmetry axis 17 of the wing member 2. A single kite-string 16 is attached to the apex of the "V" which forms the harness 14. Alternatively two kite-strings (not shown) may be used, one each connected to the two pin connections 15. As shown in FIG. 2, the connection between the kite-string 16*a* and the harness 14*a*, 14*b*, may be provided with a suitable control device 18 which controls the relative lengths 14*a*, 14*b* of the harness between the control device 18 and the pin connections 15*a*, 15*b* so as to alter the flight patterns of the device. As shown in FIG. 3, the control device may be a spool 18*a* about which the harness 14*a*', 14*b*' is coiled and to which the kite-string 16*a*' is fastened.

While the wing member 2 is bilaterally symmetrical about the first symmetry axis 17, it should be noted that the wing member 4 also is bilaterally symmetrical about a second symmetry axis 19 which is perpendicular to the first symmetry axis 17 and which is coincident with the slot 3 of the stabilizer disc 4.

The shape of the wing member 2 in the drawings is shown as elliptical with the major axis of the ellipse coinciding with the first symmetry axis 17. However the second symmetry axis 19 may be longer than the first symmetry axis 17, provided that the second symmetry axis 19 is less than the diameter of the stabilizer disc 4.

Figure 4:
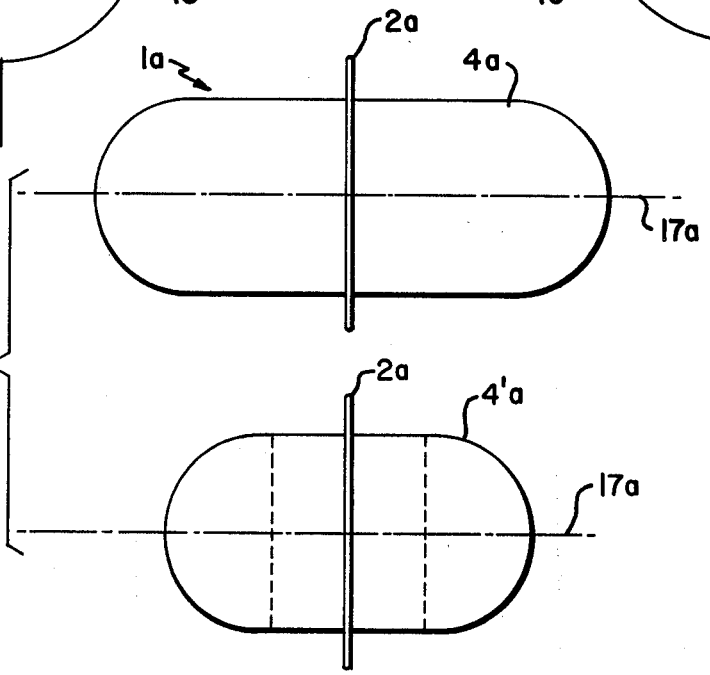
FIG. 4 is a plan view of a rotary device having a retractable flat wing member.

The flat wing member 2 also may have a diamond shape or a circular shape which accommodates two perpendicular symmetry axes. Other geometric shapes which will satisfy the need for two perpendicular symmetry axes also may be selected for the flat wing member 2. As shown in FIG. 4, it is possible to alter the aspect ratio of the flat wing member 4*a* of the device 1*a* by providing means for sliding two halves of the flat wing member 4*a* toward each other through the central slot (not shown) in the stabilizer disc 2*a* to a retracted position 4'*a*. The flat wing member retains its bilateral symmetry about the first symmetry axis 17*a* in both the extended position wherein the width of the flat wing member 4*a* is maximum and the retracted position wherein the width of the flat wing member 4'*a* is minimum.

In use as a kite, the device 1 spins about the first symmetry axis 17 with the wing member 2 having its kite-string edge (that is, the edge which is nearest to the kite-string 16 at any instant) moving upwardly. Such rotation constitutes a stable flight mode. The rotation of the device 1 may be reversed, for example, by suitable controls, by changes in the kite-string tension, so that the kite-string edge of the wing member 2 moves downwardly. This flight mode alters and the device descends rapidly. Stable flight can be restored by suitable controls or by changes in the kite-string tension. A skilled kite operator can cause the device to ascend and to descend by skillfully causing changes in the direction of rotation of the wing member 2.

The flight direction can be controlled by adjusting the angle of the plane of the wing member 2 with respect to the plane of the stabilizer disc 4. Normally the planes of the flat wing member 2 and the stabilizer disc 4 are at right angles to each other. A slight change in that angle (prior to flight in the case of a kite) will cause the device to move in a corresponding direction. The angle adjustment may be achieved by altering the relative lengths of guy wires 8, 9, 10, 11.

Mechanical linkages (not shown) or other means may be provided to regulate the relative lengths of the guy wires 9, 10, 11, 12, and thereby control the direction of movement of the device. Such mechanical linkages or other means may be operated by remote controls or by supplemental kite strings, for example, Occasionally when the device is operated as a kite, the rotation of the flat wing member may cease in flight and the kite will appear stationary for extended periods.

When the coverings 6, 12 are formed from metal foils or metallized plastic films, arresting visual effects are created as ambient lights are reflected from the rotating surfaces. One or more spot light may be directed against an airborne device to create attention-arresting light flashes in the sky. A particularly useful application of the present rotary wing device is for rescue work. Lost boats, landed aircraft, hikers, skiers, travelers can attract attention by flying the metallized kites of this invention. The turning surfaces reflect sunlight, moonlight and other ambient lights. The surfaces also may be made from a microwave-reflective material to facilitate identification of the devices by radar detection equipment.

The rotary wing device 1, free of harness and kite-strings, can be used as a free flight toss-and-catch toy thrown from one person to another. Multiple units of the device might be tossed into the air for free flight creating sparking visual effects in the sky.

Figure 5:
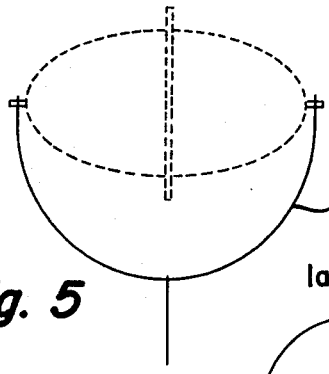
FIG. 5 is a plan view of a rotary wing device having a rigid arcuate harness.
Figure 6:
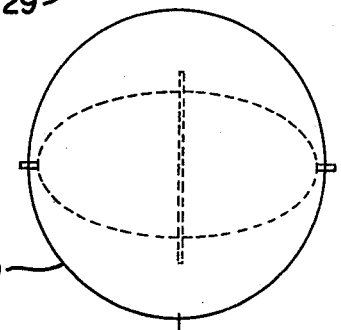
FIG. 6 is a plan view of a rotary wing device having a rigid enclosed arcuate harness.

As shown in FIG. 5, the harness may be fabricated as a rigid arcuate member 18 from lightweight metal rods or tubing, plastic rods or tubing, especially fiber-reinforced plastic tubing. The rigid arcuate member 18 accommodates the rotation of the device and precludes the possibility of interference between the harness and the rotation and thus renders the device snag-proof. The open ends of the rigid arcuate member 18 are rotatably connected to the pin members. Alternatively as shown in FIG. 6, the harness may be fabricated as an enclosed rigid member 19, circular or elliptical in form from the same lightweight materials. The enclosed harness is connected at diametrically opposed points to the pin members. The enclosed harness has the advantages of the arcuate harness of FIG. 5, i.e., it is snag-proof, but in addition the harness of FIG. 6 has an interesting benefit when the device is employed as a tosstoy. By proper manipulation, the rotary device of Fig. 6 will perform like a boomerang and will return gracefully to the thrower.

With appropriate materials of construction, the present device can be produced with a diameter (stabilizer disc) of three feet and a weight of three ounces or less.

As shown in FIG. 5, multiple units 20 (20') of the device may be assembled on a common frame 21 which has opposed yoke arms 22, 23 (22', 23') with bearings 24, 25 (24', 25'). The wing members 26 (26') of the multiple units 20 (20') have a lengthwise shaft 27 (27') connected through the bearing 24, 25 (24', 25') to a pulley 28 (28') which in turn is connected through a drive belt 29 (29') to a drive pulley 30 (30') which is driven by a suitable reversing power source 31 (31'). By positively driving the wing members 26 (26') in the same or in opposite directions, and by properly adjusting the inclination of the stabilizer discs 32, 32' to wing members 26, 26' for the units 20 (20'), the movement of the assembly of FIG. 5 can be controlled in free flight.

I claim:

1. A rotary wing device having a flat circular stabilizer disc with a slot along a diameter thereof;

a flat wing member extending through the said slot and having bilateral symmetry about a first symmetry axis which is perpendicular to the plane of the said stabilizer disc and which passes through the center thereof, and also having bilateral symmetry about a second symmetry axis which is perpendicular to the said first symmetry axis and which coincides with the said slot;

said stabilizer disc and said flat wing member each comprising a thin, lightweight rod or tubing peripheral frame covered with a lightweight membrane;

at least one guy wire connecting the frame of the said stabilizer disc to the frame of the said wing member in each quadrant of the device, each said guy wire functioning to transfer stresses from the frame of the said stabilizer disc to the frame of the said flat wing member.

2. The rotary wing device of claim 1 having pin members secured to the said wing member peripheral frame at the ends of the said flat wing member at the intersection of the said first symmetry axis with the edges of the said flat wing member.

3. The rotary wing device of claim 2 including a "V" shape harness having its open ends secured, one each to the said pin members and having a kite-string secured to the apex of the "V".

4. The rotary wing device of claim 3 wherein the said harness has means secured at the apex of the "V" for establishing the relative lengths of the two open ends of the said harness and said kite-strings is secured to said relative length establishing means.

5. The rotary wing device of claim 1 wherein opposed guy wires can be detached to permit folding of the said stabilizer disc flat about the said slot against the said flat wing member about the said slot.

6. The rotary wing device of claim 1 wherein the said membrane has a light-reflecting surface.

7. The rotary wing device of claim 1 wherein each said membrane covering said peripheral frame consists of polyethylene terephthalate film.

8. The rotary wing device of claim 1 wherein the said membrane has a metallized light-reflecting surface.

9. The rotary wing device of claim 1 wherein each said peripheral frame is made from plastic rod or tubing.

10. The rotary wing device of claim 2 including a rigid arcuate harness having its open ends rotatably connected to the said pin members.

11. The rotary wing device of claim 2 including an enclosed arcuate rigid harness, connected at diametrically opposed points to the said pin members.

12. The rotary wing device of claim 1 wherein the said flat wing member is fabricated from two sections, each of which can be moved through the said slot of the said stabilizer disc from a retracted position wherein the width of the flat wing member is minimum to an extended position wherein the width of the said flat member is maximum.

* * * * *